US008517780B2

(12) United States Patent
Yu et al.

(10) Patent No.: US 8,517,780 B2
(45) Date of Patent: Aug. 27, 2013

(54) CONNECTOR HAVING A CONTACT ARM CONNECTED IN BETWEEN TWO CONNECTING ARMS

(75) Inventors: Wei Yu, Shenzhen (CN); Kefu Wang, Shenzhen (CN); Haijun Zhang, Shenzhen (CN)

(73) Assignee: Shenzhen Sunway Communication Co., Ltd. (CN)

( * ) Notice: Subject to any disclaimer, the term of this patent is extended or adjusted under 35 U.S.C. 154(b) by 3 days.

(21) Appl. No.: 13/387,854

(22) PCT Filed: Sep. 9, 2010

(86) PCT No.: PCT/CN2010/076779

§ 371 (c)(1), (2), (4) Date: Jan. 30, 2012

(87) PCT Pub. No.: WO2011/079625

PCT Pub. Date: Jul. 7, 2011

(65) Prior Publication Data

US 2012/0135647 A1 May 31, 2012

(30) Foreign Application Priority Data

Jan. 4, 2010 (CN) ..... 2010 1 0042723
Apr. 21, 2010 (CN) ..... 2010 1 0153064

(51) Int. Cl.
*H01R 4/48* (2006.01)

(52) U.S. Cl.
USPC ..... 439/862

(58) Field of Classification Search
USPC ..... 439/852, 862, 824, 74
See application file for complete search history.

(56) References Cited

U.S. PATENT DOCUMENTS

| | | | | |
|---|---|---|---|---|
| 5,562,501 | A * | 10/1996 | Kinoshita et al. | 439/852 |
| 5,655,913 | A * | 8/1997 | Castaneda et al. | 439/66 |
| 6,325,661 | B1 * | 12/2001 | Tabata | 439/459 |
| 6,783,370 | B2 * | 8/2004 | Miyamoto et al. | 439/66 |
| 7,455,556 | B2 * | 11/2008 | Mendenhall et al. | 439/862 |
| 7,614,883 | B2 * | 11/2009 | Mendenhall et al. | 439/66 |
| 7,625,216 | B2 * | 12/2009 | Mendenhall et al. | 439/66 |

FOREIGN PATENT DOCUMENTS

| | | |
|---|---|---|
| CN | 1110017 A | 10/1995 |
| CN | 201117897 Y | 9/2008 |
| JP | 2001-053457 A | 2/2001 |

OTHER PUBLICATIONS

International Search Report corresponding to PCT Application No. PCT/CN2010/076779, mailed Dec. 16, 2010 (4 pages).

* cited by examiner

*Primary Examiner* — Chandrika Prasad
(74) *Attorney, Agent, or Firm* — Maginot, Moore & Beck LLP

(57) ABSTRACT

A connector comprises a base plate defining a first end and a second end along a longitudinal direction, a first connecting arm, a first end of which is connected with the second end of the base plate, and a second end of which is substantially extended upwards relative to the first end thereof, a contact arm, a first end of which is connected with the second end of the first connecting arm, and a second connecting arm, a first end of which is connected with a second end of the contact arm, and a second end of which is substantially extended downwards to the base plate so as to be contactable with the base plate. The connector has multiple connecting paths, thus realizing good high-frequency characteristics.

15 Claims, 4 Drawing Sheets

CONNECTOR HAVING A CONTACT ARM CONNECTED IN BETWEEN TWO CONNECTING ARMS

TECHNICAL FIELD

The present disclosure generally relates to a connector, and more particularly to a multi-path electrical connector.

BACKGROUND

Electrical connectors have been widely used, for example, for connecting electronic components onto circuit boards. FIG. 7 shows a conventional electrical connector which comprises a sheet body 10' and an elastic arm 11' which is raised upwards from one end of the body 10', one end of the elastic arm 11' is connected with the body 10' and the other end thereof has an substantially arc shape. When used, the body 10' is soldered onto a printed circuit board (PCB), the electronic component contacts the elastic arm 11' and presses the elastic arm 11' downwards, thus the electronic component is connected with the circuit board. Meanwhile, the contact between the elastic arm 11' and the electronic component is merely realized by the upward elastic force of the elastic arm 11'.

The conventional connector has following defects:

Firstly, the conventional connector has only one connecting path which is formed by the elastic arm 11', and this is the only one connecting path for high-frequency current flowering between the electronic component and the circuit board. Therefore, high-frequency characteristics of the connector are poor.

Secondly, since the reliability of the contact between the elastic arm 11' and the electronic component is ensured only by the elastic force of the elastic arm 11', thereby the deformation of the elastic arm 11' and the internal stress thereof are big, moreover the elastic force is in a limited range, so that the reliability of the contact is decreased, and the duration of the elastic arm 11' is relatively short.

Thirdly, if the elastic arm 11' is pressed downwards by the electronic component excessively, the elastic arm 11' may probably contact the circuit board, resulting in some faults such as short circuit. In addition, If the elastic arm 11' is pressed down excessively, it may deform permanently and can not restore even when the electronic component is removed. Therefore, the deformed elastic arm 11' can not generate the upward elastic force when being pressed by the electronic component, thus affecting the reliability of contact between the elastic arm 11' and the electronic component.

Fourthly, the elastic arm 11', when depressed downwards, may move in a lateral direction shown in FIG. 7. Therefore, a twisting force may be generated in the elastic arm 11', thus destroying connection between the body 10' and the circuit board.

SUMMARY

The present disclosure is directed to solve at least one of the problems exiting in the prior art. Accordingly, a connector having multiple connecting paths is provided.

According to an embodiment of the present disclosure, the connector comprises: a base plate defining a first end and a second end along a longitudinal direction;

a first connecting arm, a first end of which is connected with the second end of the base plate, and a second end of which is substantially extended upwards relative to the first end thereof; a contact arm, a first end of which is connected with the second end of the first connecting arm; and a second connecting arm, a first end of which is connected with a second end of the contact arm, and a second end of which is substantially extended downwards to the base plate so as to be contactable with the base plate.

In the above embodiment, the connector has multiple connecting paths, thereby the high-frequency current may flow along the path whose impedance is smallest, so that good high-frequency characteristics thereof can be realized without high-frequency disturbance.

Additionally, the connector further comprises a third connecting arm connected between the first connecting arm and the contact arm and substantially parallel to the base plate.

Further, the first connecting arm is configured as a C shape, U shape or V shape, and an open of which faces forwards in the longitudinal direction.

Further, a block notch is formed in a part of the first connecting arm near to the first end thereof and recessed upwards.

Optionally, the block notch is configured as an arc shape and an open thereof faces downwards.

Additionally, the second end of the contact arm is extended upwards and then bent to extend downwards relative to the first end thereof.

Optionally, the second end of the contact arm is bent in the form of arc.

Optionally, a contact portion is formed on a top of the contact arm.

Particularly, the contact portion is formed via plating the top of the contact arm.

Further, the second end of the second connecting arm is extended downwards to the base plate so as to be contactable with the base plate, and then bent to obliquely extend away from the base plate upwards.

Furthermore, the second connecting arm is bent in the form of arc.

In an embodiment of the disclosure, the second connecting arm is normally contacted with the base plate.

In another embodiment of the disclosure, the second connecting arm is normally disconnected from the base plate, and contacted with the base plate only when the contact arm is pressed downwards.

Further, the connector is formed integrally by bending a single piece of elastic metal sheet.

The connector further comprises side plates disposed at two sides of the base plate respectively in a lateral direction B substantially perpendicular to the longitudinal direction.

Further, the first end of the base plate is aligned with bottom edges of the side plates and the second end thereof is extended beyond the bottom edges in the longitudinal direction.

Further, a top of each side plate is higher than the second end of the first connecting arm and the first end of the contact arm.

Further, the top of each side plate has an arc shape.

Further, the side plates and the base plate are integrally formed by a single metal sheet.

Additional aspects and advantages of the embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the disclosure will become apparent and more readily appreciated from the following descriptions taken in conjunction with the drawings, in which.

The following drawings will help the above-mentioned and additional advantages of the disclosure to be more understandable.

DETAILED DESCRIPTION

Figure 1:
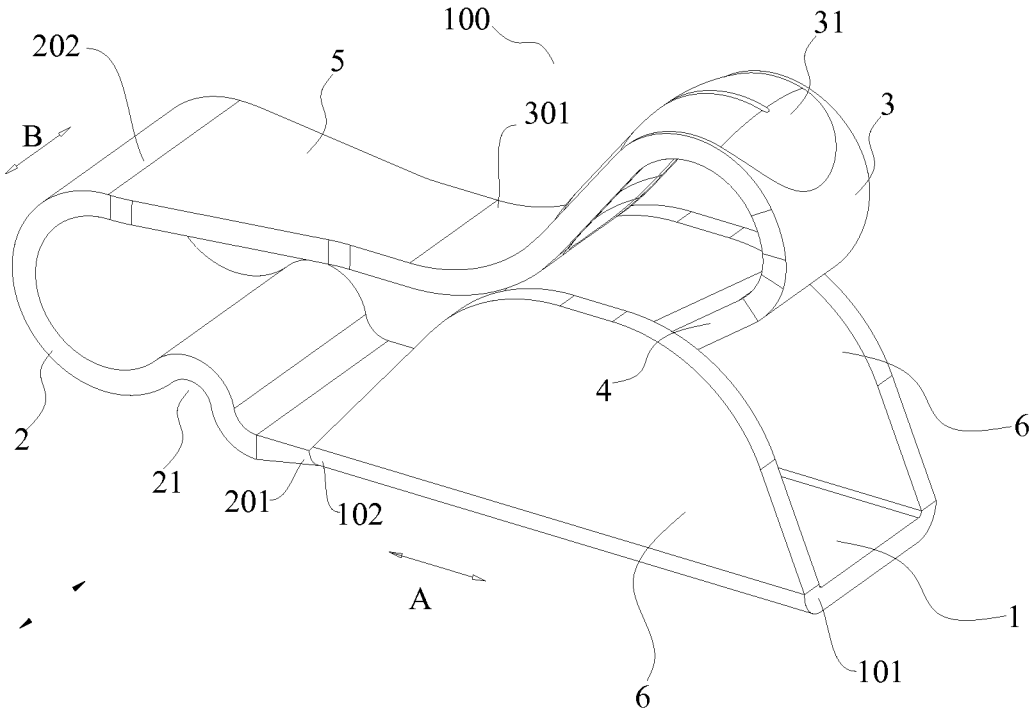
FIG. 1 is a schematic perspective view of the connector which is one of the embodiments of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the description, relative terms such as "longitudinal", "lateral", "down", "up", "horizontal", "vertical", "right", "left", "top", "bottom" as well as derivative thereof (e.g., "horizontally", "downwards", "upwards", etc.) should be construed to refer to the orientation as then described or as shown in the drawings under discussion. These relative terms are for convenience of description and do not require that the present disclosure be constructed or operated in a particular orientation. Terms concerning attachments, coupling and the like, such as "connected" refer to a relationship wherein structures are secured or attached to one another either directly or indirectly through intervening structures, unless expressly described otherwise.

The connector 100 according to an embodiment of the present disclosure will be described in detail with reference to the drawings below.

As shown in FIGS. 1-4, the connector 100 according to an embodiment of the present disclosure comprises a base plate 1, a first connecting arm 2, a contact arm 3, and a second connecting arm 4.

Figure 2:
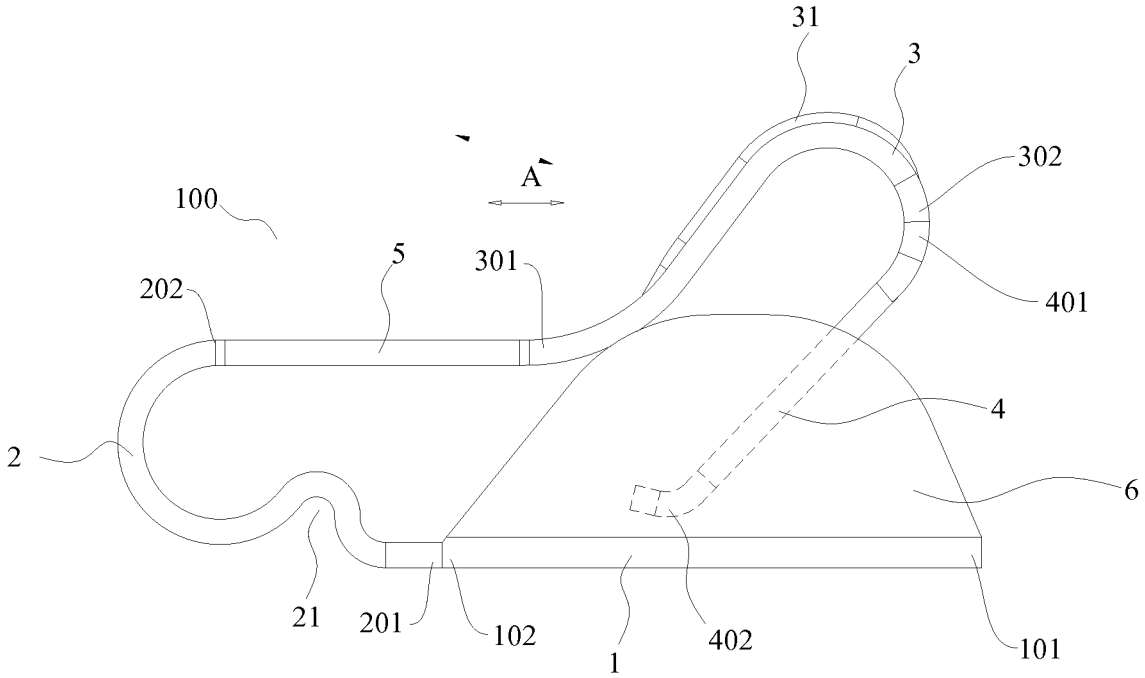
FIG. 2 is a front view of the connector shown in FIG. 1.
Figure 4:
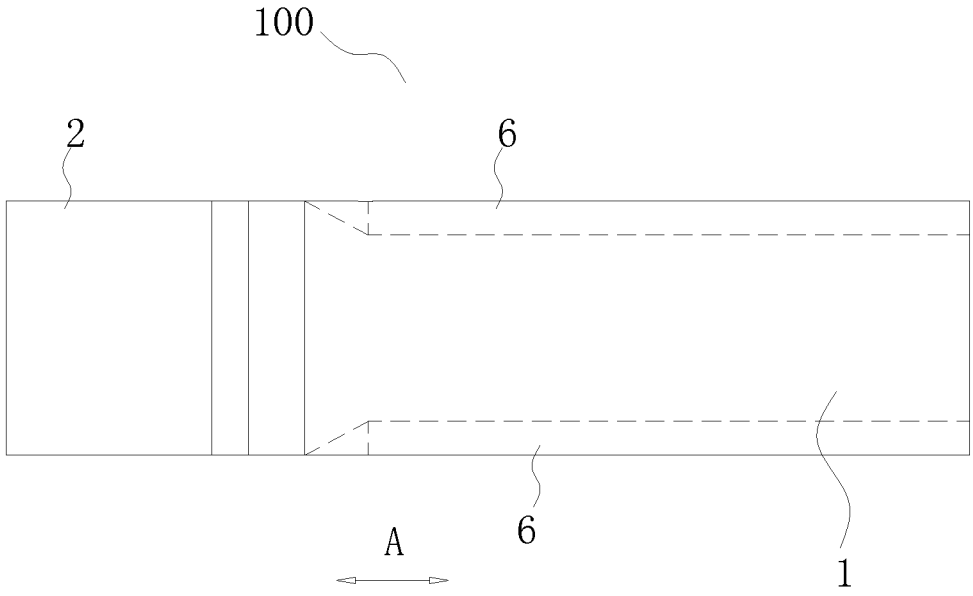
FIG. 4 is a bottom view of the connector shown in FIG. 1.

The base plate 1 has a first end 101 (the right end shown in FIG. 2) and a second end 102 (the left end shown in FIG. 2) along a longitudinal direction A (left and right direction in FIG. 2 and FIG. 4). A first end 201 (the bottom end shown in FIG. 2) of the first connecting arm 2 is connected with the second end 102 of the base plate 1, and a second end 202 (the top end shown in FIG. 2) of the first connecting arm 2 is substantially extended upwards relative to the first end thereof.

It will be appreciated by those skilled in the art that the term 'upwards' refers to a direction comprising a vertically upward direction, an obliquely upward direction and a crookedly upward direction, and the term "downwards" refers to a direction comprising a vertically downward direction, an obliquely downward direction and a crookedly downward direction. For example, as shown in FIG. 2, the second end 202 of the first connecting arm 2 is extended upwards in the form of arc. Furthermore, "extended upwards" refers to a state that the second end 202 of the first connecting arm 2 is higher than the first end of the first connecting arm 2.

In some embodiments of the present disclosure, the first connecting arm 2 is configured as a C shape, U shape or V shape. As shown in FIGS. 1-4, the first connecting arm 2 is configured as a substantially C-shaped arc, and the open of the first connecting arm 2 faces towards the right, thus increasing elasticity of the first connecting arm 2. Therefore, the elastic force, by which the contact between an electronic component 300 and the contact arm 3 is maintained, is provided by both the first connecting arm 2 and the contact arm 3. The internal stress of each of the first connecting arm 2 and the contact arm 3 is decreased under the condition of the same elastic force, thus enhancing the duration of the connector 100, which will be described in detail below.

In some embodiments of the present disclosure, as shown in FIGS. 1 and 2, a block notch 21 is formed in a part of the first connecting arm 2 near to the first end 201 of the first connecting arm 2 and recessed upwards. More specifically, the block notch 21 has an arc shape and an open thereof faces downwards. In embodiments of the present disclosure shown in FIGS. 1-2, the block notch 21 is obliquely recessed upwards to the right. In other words, the open of the block notch 21 faces downwards to the left. However, the present disclosure is not limited this. The block notch 21 may be vertically recessed upwards and the open thereof faces downwards in the vertical direction. Optionally, the block notch 21 may be recessed upwards to the left.

The block notch 21 can block soldering tin and retrain it therein, thus preventing it from flowing to the first connecting arm 2 when the base plate 1 is soldered with the circuit board 200 (shown in FIG. 6), therefore the soldering between the lower surface of the base plate 1 and the circuit board 200 is reliable and the elasticity of the first connecting arm 2 will be not disadvantageously affected.

As shown in FIGS. 1 and 2, a first end 301 of the contact arm 3 is connected with the second end 202 of the first connecting arm 2, and the second end 302 of the contact arm 3 is extended upwards to the right.

In some embodiments of the present disclosure, a third connecting arm 5 is connected between the first end 301 of the contact arm 3 and the second end 202 of the first connecting arm 2 and substantially parallel to the base plate 1. It will be appreciated that the third connecting arm 5 may be formed as or regarded as a portion of the contact arm 3.

A first end 401 (the top end shown in FIG. 2) of the second connecting arm 4 is connected with the second end 302 of the contact arm 3, and a second end 402 of the second connecting arm 4 is substantially extended downwards to the base plate 1 and contactable with the base plate 1. In embodiments of the present disclosure shown in FIGS. 1-2, the second end 402 of the second connecting arm 4 is obliquely extended downwards to the left towards the base plate 1. However, the present disclosure is not limited this, for example, the second end 402 of the second connecting arm 4 may be extended downwards in the vertical direction.

Figure 5:
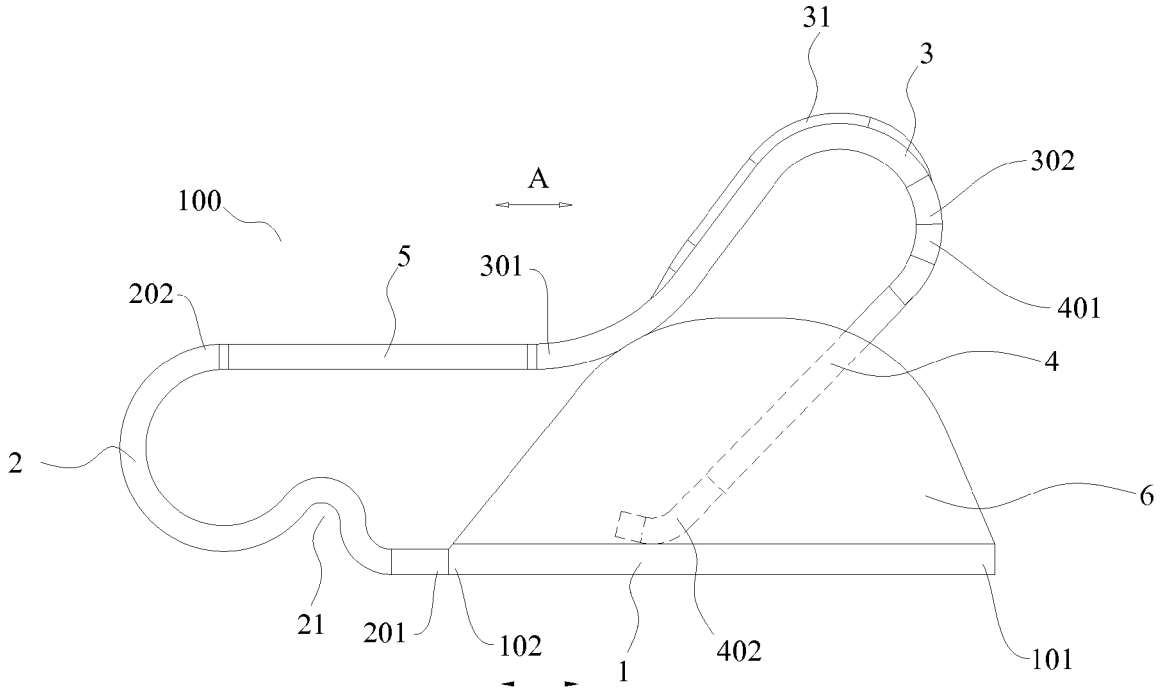
FIG. 5 is a front view of the connector shown in FIG. 1.

As shown in FIG. 5, according to another embodiment, the second end 402 of the second connecting arm 4 may be normally contacted with the base plate 1, that is, the second end 402 of the second connecting arm 4 is always contacted with the upper surface of the base plate 1 whether the contact arm 3 is pressed downwards or not. Optionally, the second connecting arm 4 may be normally disconnected from the base plate 1, and connected with the base plate 1 when the contact arm 3 is pressed downwards by the electronic component 300, as shown in FIG. 2.

Figure 6:
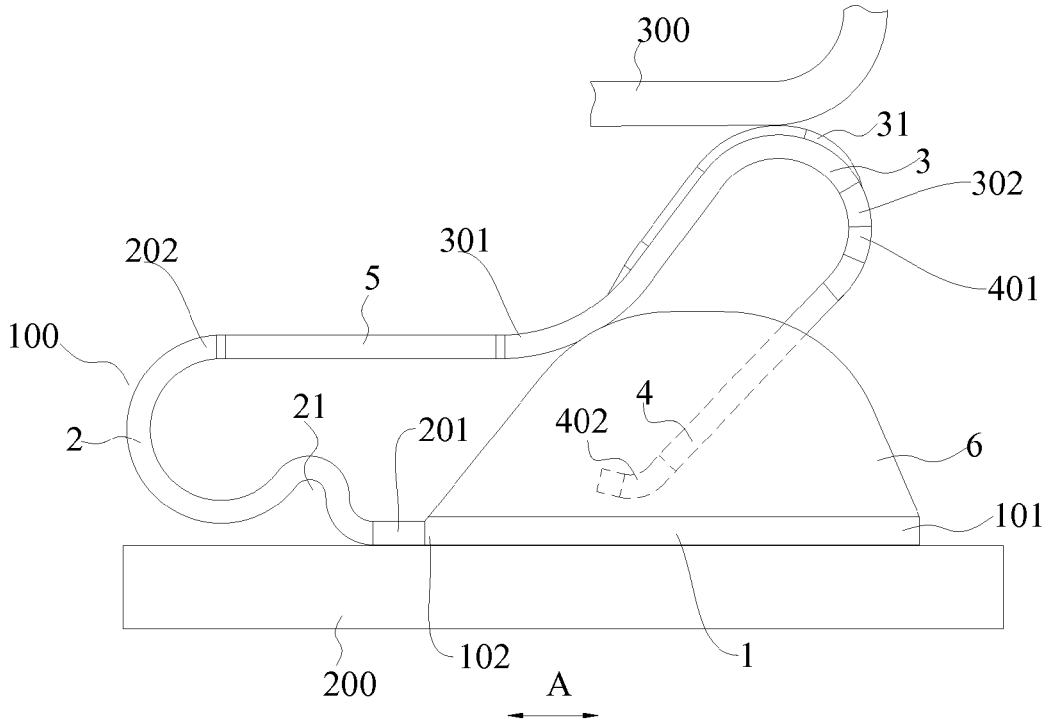
FIG. 6 is a schematic perspective view showing the connection among the connector, circuit board and electric component.
Figure 7:
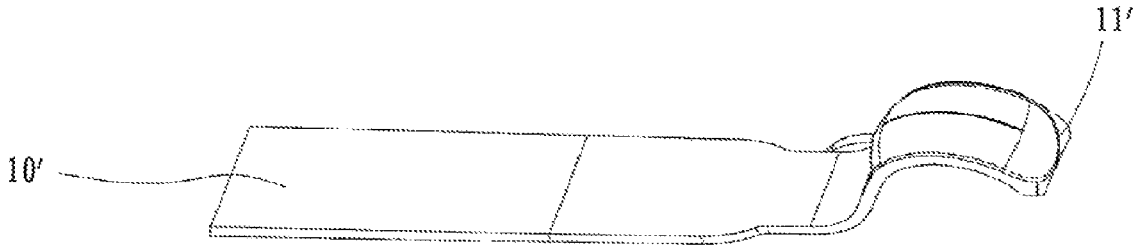
FIG. 7 is a schematic view of the traditional connector with single connecting path.

Therefore, as shown in FIG. 6, the connector 100 according embodiments of the present disclosure, for example, has two connecting paths. The electronic component 300 contacts with contact arm 3 and presses it downwards; then contact arm 3 deforms together with the first connecting arm 2. There are two connecting paths between the contact arm 3 and the base plate 1, namely, between the electronic component 300 and circuit board 200. The first path is: contact arm 3—third connecting arm 5—the first connecting arm 2—base plate 1, and the second path is: contact arm 3—the second connecting arm 4—base plate 1.

Therefore, the high-frequency can flow along the path whose impendence is the smallest, so that high-performance high-frequency characteristics can be realized, and high-frequency disturbance can be avoided. Meanwhile, the elastic force, by which the contact between the connector 100 and the electronic component 300 is maintained, is increased. Since the elastic force is provided by deformation of both the contact arm 3 and the first connecting arm 2, the reliability of the contact between the electronic component 300 and the circuit board 200 is enhanced. Furthermore, for the same elastic force, the internal stress of each of the contact arm 3 and the electronic component 300 is reduced, thus increasing the duration of the connector 100.

In some embodiments of the present disclosure as shown in FIGS. 1-4, the second end 302 of the contact arm 3 is extended upwards and then bent to extend downwards relative to the first end thereof. That is, the second end 302 of the contact arm 3 is extended upwards to the right, and then bent to extend downwards in the form of arc. As shown in FIG. 2, the second end 302 of the contact arm 3 is higher than the first end 301 of the contact arm 3. However, the present disclosure is not limited this.

In an example of the present disclosure as shown in FIG. 2, the second end 402 of the second connecting arm 4 is extended downwards to the base plate 1 so as to be contactable with the base plate 1, and then bent to extend upwards away from the base plate 1. Namely, the second end 402 of the second connecting arm 4 is obliquely extended to the lower left direction and towards the base plate 1, and then bent in the form of arc to extend upwards to the left. In other words, the second end 402 of the second connecting arm 4 has a substantially L shape with a transition arc.

Figure 3:
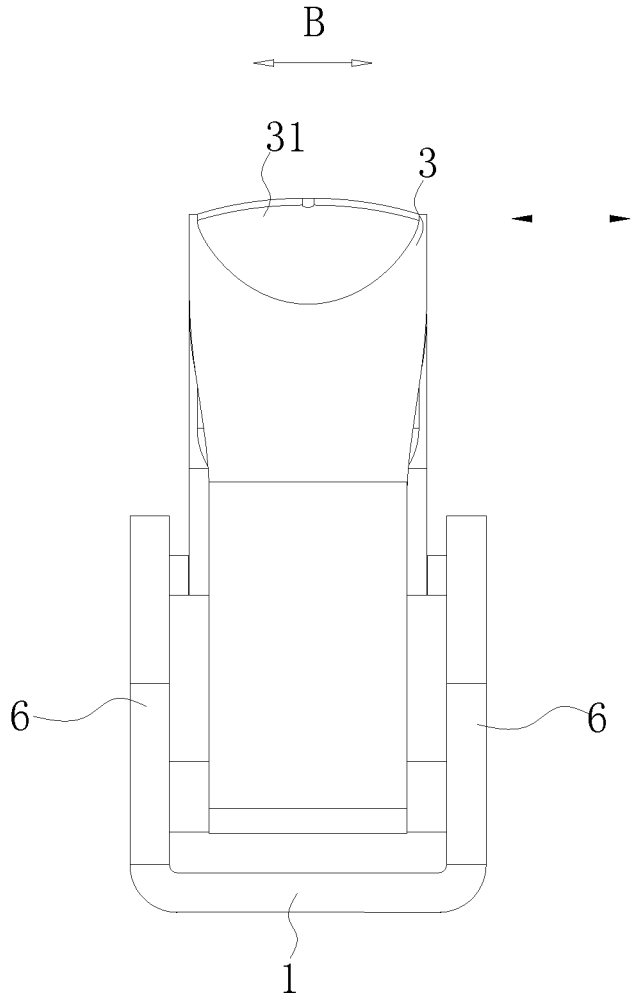
FIG. 3 is a right view of the connector shown in FIG. 1.

As shown in FIGS. 1-3, in order to increase reliability of the contact between the electronic component 300 and the contact arm 3, a contact portion 31 is formed on a top of the contact arm 3.

In embodiments of the present disclosure as shown in FIGS. 1-5, the connector 100 further comprises two side plates 6 which are disposed at two sides of the base plate 1 respectively in a lateral direction B substantially perpendicular to the longitudinal direction A. As shown in FIGS. 2 and 4, the first end 101 of the base plate 1 is aligned with bottom edges of the side plates 6 and the second end 102 of the base plate 1 is extended beyond the bottom edges of the side plates 6 in the longitudinal direction A. The top of each side plate 6 is higher than the second end 202 of the first connecting arm 2 and the first end 301 of the contact arm 3. In an example of the present disclosure, the top of each side plate 6 has an arc shape. That is, each side plate 6 tapers upwards viewing from the lateral direction B. In an embodiment of the present disclosure as shown in FIG. 3 and FIG. 4, the side plates 6 are respectively disposed on the upper surface of the base plate 1 and aligned with the base plate 1 in the lateral direction B. Furthermore, the side plates 6 and the base plate 1 may be integrally formed by a single metal sheet, for example, by stamping a single elastic metal sheet. However, the present disclosure is not limited to the above example.

By provision of the side plates 6, firstly, when the contact arm 3 is pressed downwards and the second arm 4 moves, the side plates 6 may guide and limit the movement of the second connecting arm 4 relative to the base plate 1, so that twisting between the second connecting arm 4 and the contact arm 3 and the resulting damage to the connection between the base plate 1 and the circuit board 200 can be avoided. In addition, the side plates 6 may prevent the contact arm 3 and the first connecting arm 2 from being over-pressed and losing of elasticity thereof.

By designing the top of each side plate 6 to have an arc shape, the static electricity may be prevented from generating at the top of each side plate 6, thus avoiding damage of the static electricity to the electronic component 300.

The connector 100 of the embodiments of the present disclosure may be integrally formed by bent a single elastic metal sheet such as a beryllium copper sheet. Therefore, the manufacturing of the connector 100 is easy and low in cost. In addition, the connector 100 may be plated on the surface thereof, for example with a plating thickness of 2μ-10μ. In order to save plating material such as gold and decrease cost, only the base plate 10 and the contact portion 31 on the top of the contact arm 3 are plated, so as to enhance soldering performance of the base plate 1 and improve the contacting performance and electric conducting performance between the contact arm 3 and the electronic component 300, thus increasing the electric conductivity.

In an example of the present disclosure, the width of the connector 100 (namely size in the lateral direction B) is about 0.8-1.5 mm; the height thereof (namely size in the top and bottom direction) is more than 1.6-4.0 mm; the length thereof (namely size in the longitudinal direction A) is about 3.0-7.0 mm; the compressed dimension is about 0.6-1.2 mm. The beryllium copper sheet used to manufacture the connector 100 has a thickness of about 0.08-0.2 mm, so that the accuracy of manufacturing is high. The form and position tolerance thereof is equal or less than ±0.05 mm, full dimension CPK (Process Capability index) is 1.33, and its MP (mass production) consistency is good.

The connector 100 of the embodiment of the present disclosure is arc-transited overall without hooks and acute angles, so that the connectors will not hook each other in manufacture process (pre-plating stamping and plating process). In addition, when the connector 100 is soldered on the circuit board 200, it will not hook other components either.

The connector 100 according to embodiments of the present disclosure is complied with the REACH standard (Concerning the Registration, Evaluation, Authorization and Restriction of Chemicals). The connector 100 has good resistance to corrosion, shock and impact. It passes 48-hour salt-spray test under the condition of concentration 5% and PH 7.0; Vibration Test IEC 68-2-36; and Impact Test IEC 68-2-27.

The operation and use of the connector 100 according to embodiments of the disclosure will be described below.

As shown in FIG. 6, the connector 100 according to embodiments of the present disclosure is soldered to the circuit board 200 via the base plate 1. The electronic component 300 is positioned above the contact arm 3. The contact arm 3 and the first connecting arm 2 are pressed when the contact arm 3 is pressed downwards, so that the upward elastic force is generated. The electronic component 300 is contacted with the contact portion 31 of the contact arm 3 via the elastic force of the contact arm 3 and the first connecting arm 2. At the same time, the second connecting arm 4 moves downwards, and the second end 402 of the second connecting arm 4 moves downwards to the left relative to the base plate 1 so as to contact the base plate 1. The second end 302 of the contact arm 3 and the second connecting arm 4 stop moving downwards further due to blocking of the side plates 6 after moving a predetermine distance, thus preventing the contact arm 3 and the second connecting arm 4 from being over-compressed.

As described above, the connector 100 according to embodiments of the present disclosure has two connecting paths between the electronic component 300 and the circuit board 200 (namely, between the contact portion 31 of the contact arm 3 and the base plate 1): the first path: the contact arm 3—the third connecting arm 5—the first connecting arm 2—and the base plate 1; the second path: the contact arm 3—the second connecting arm 4—the base plate 1.

Therefore, the connector 100 has one more connecting path than the conventional connector, so that one more path is provided for the high-frequency current between the base plate 1 and the contact portion 31. The high-frequency current may flow along the path whose impedance is smallest, so as to realize good high-frequency characteristics without high-frequency disturbance. Furthermore, the elastic force, by which the contact between the connector 100 and the electronic component 300 is maintained, is provided by co-deformation of the contact arm 3 and the first connecting arm 2, thus increasing the elastic force and enhancing the reliability of the contact between the electronic component 300 and the circuit board 200. With the same elastic force, the stress is dispersed, the internal stress in the contact arm 3 and the first connecting arm 2 is consequently decreased, and the duration of connector 100 is improved. In addition, the side plates 6 may guide the movement of the contact arm 3 and the second connecting arm 4, thus avoiding twisting of the connector 100 which may destroy the connection between the connector 100 and the circuit board 200, and preventing the contact arm 3 and the first connecting arm 2 from being over-pressed and losing elasticity thereof. The top of the side plates 6 has an arc-shape, thus avoiding the static electricity created at the top of the side plates 6 and eliminating the damage of static electricity to the electronic component 300.

The connector 100 according to embodiments of the present disclosure is arc-transited overall without sharp hooks and acute angles, and integrally formed by bending a single piece of elastic metal sheet such as a beryllium copper sheet. Therefore, the manufacturing of connector 100 is simple, and the connector 100 will not hook other components during assembly.

Reference throughout this specification to "an embodiment," "some embodiments," "one embodiment", "another example," "an example," means that a particular feature, structure, material, or characteristic described in connection with the embodiment or example is included in at least one embodiment or example of the disclosure. Thus, the appearances of the phrases such as "in some embodiments," "in one embodiment", "in an embodiment", "another example, "an example," in various places throughout this specification are not necessarily referring to the same embodiment or example of the disclosure. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications can be made in the embodiments without departing from spirit and principles of the disclosure. Such changes, alternatives, and modifications all fall into the scope of the claims and their equivalents.

What is claimed is:

1. A connector, comprising:

a base plate defining a first end and a second end along a longitudinal direction;

a first connecting arm defining a first end connected with the second end of the base plate, and an opposite second end substantially extended upwards relative to the first end of the first connecting arm;

a contact arm defining a first end connected with the second end of the first connecting arm and an opposite second end;

a second connecting arm defining a first end connected with the second end of the contact arm, and an opposite second end, the second connecting arm configured to substantially extend downwards and backwards towards the second end of the base plate from the first end to the second end of the second connecting arm so as to be contactable with the base plate, the second end being bent to obliquely extend away from the base plate upwards; and side plates disposed at two sides of the base plate respectively in a lateral direction and extending substantially perpendicular to the longitudinal direction, in which the top of each side plate has an arc shape and is lower than a top portion of the contact arm.

2. The connector according to claim 1, further comprising:

a third connecting arm connected between the first connecting arm and the contact arm and substantially parallel to the base plate.

3. The connector according to claim 1, wherein the first connecting arm is configured as a C shape, U shape or V shape opening forwards in the longitudinal direction.

4. The connector according to claim 1, wherein a block notch is formed in a part of the first connecting arm near to the first end thereof and recessed upwards.

5. The connector according to claim 4, wherein the block notch is configured as an arc shape opening downwards.

6. The connector according to claim 1, wherein the second end of the contact arm is extended upwards and then bent to extend downwards relative to the first end thereof.

7. The connector according to claim 6, wherein the second end of the contact arm is bent in the form of arc.

8. The connector according to claim 6, wherein a contact portion is formed on a top of the contact arm, and wherein the contact portion is formed via plating the top of the contact arm.

9. The connector according to claim 1, wherein the second connecting arm is bent in the form of arc.

10. The connector according to claim 1, wherein the second connecting arm is normally contacted with the base plate.

11. The connector according to claim 1, wherein the second connecting arm is normally disconnected from the base plate, and contacted with the base plate only when the contact arm is pressed downwards.

12. The connector according to claim 1, wherein the connector is formed integrally by bending a single piece of elastic metal sheet.

13. The connector according to claim 1, wherein the first end of the base plate is aligned with bottom edges of the side plates and the second end thereof is extended beyond the bottom edges in the longitudinal direction.

14. The connector according to claim 1, wherein a top of each side plate is higher than the second end of the first connecting arm and the first end of the contact arm.

15. The connector according to claim 1, wherein the side plates and the base plate are integrally formed by a single piece of elastic metal sheet.

* * * * *

UNITED STATES PATENT AND TRADEMARK OFFICE
Certificate

Patent No. 8,517,780 B2 Patented: August 27, 2013

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Wei Yu, Shenzhen (CN); Kefu Wang, Shenzhen (CN); Haijun Zhang, Shenzhen (CN); Huilin Wu, Shenzhen (CN); Yihong Qi, Shenzhen (CN); and Zhongrong Zhou, Shenzhen (CN).

Signed and Sealed this Nineteenth Day of August 2014.

AMY COHEN JOHNSON
*Supervisory Patent Examiner*
Art Unit 2833
Technology Center 2800

UNITED STATES PATENT AND TRADEMARK OFFICE

CERTIFICATE OF CORRECTION

PATENT NO. : 8,517,780 B2
APPLICATION NO. : 13/387854
DATED : August 27, 2013
INVENTOR(S) : Wei Yu et al.

It is certified that error appears in the above-identified patent and that said Letters Patent is hereby corrected as shown below:

On the Title Page

Please change the address for the above-referenced inventors and the below Assignee to the following:

(75) Inventors: Wei Yu, Kefu Wang, Haijun Zhang, Huilin Wu, Yihong Qi and Zhongrong Zhou Building A&B, No. 1013 Xihuan Road, Shajing Street, Bao'an District
Shenzhen, Guangdon 518104
P.R. China

(73) Assignee: Shenzhen Sunway Communication Co., Ltd.
Building A&B, No. 1013 Xihuan Road, Shajing Street, Bao'an District
Shenzhen, Guangdong 518104
P.R. China Signed and Sealed this
Twenty-fifth Day of November, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,517,780 B2
APPLICATION NO. : 13/387854
DATED : August 27, 2013
INVENTOR(S) : Wei Yu et al.

It is certified that error appears in the above-identified patent and that said Letters Patent is hereby corrected as shown below:

On the Title Page

Please change the address for the above-referenced inventors and the below Assignee to the following:

(75) Inventors: Wei Yu, Kefu Wang, Haijun Zhang, Huilin Wu, Yihong Qi and Zhongrong Zhou Building A&B, No. 1013 Xihuan Road, Shajing Street, Bao'an District
Shenzhen, Guangdong 518104
P.R. China

(73) Assignee: Shenzhen Sunway Communication Co., Ltd.
Building A&B, No. 1013 Xihuan Road, Shajing Street, Bao'an District
Shenzhen, Guangdong 518104
P.R. China This certificate supersedes the Certificate of Correction issued November 25, 2014.

Signed and Sealed this
Twenty-third Day of December, 2014

Michelle K. Lee

Michelle K. Lee
*Deputy Director of the United States Patent and Trademark Office*